US005222756A

United States Patent [19]

Gorza

[11] Patent Number: 5,222,756

[45] Date of Patent: Jun. 29, 1993

[54] SKI BOOT FASTENING DEVICE

[75] Inventor: Roberto Gorza, Feltre, Italy

[73] Assignee: Nordica S.p.A., Montebelluna, Italy

[21] Appl. No.: 895,432

[22] Filed: Jun. 5, 1992

Related U.S. Application Data

[63] Continuation of Ser. No. 600,885, Oct. 22, 1990, abandoned.

[30] Foreign Application Priority Data

Oct. 27, 1989 [IT] Italy ..... 82600 A/89

[51] Int. Cl.[5] ..... A63C 9/08

[52] U.S. Cl. ..... 280/616; 280/617; 280/633; 280/634

[58] Field of Search ..... 280/616, 617, 618, 620, 280/631, 632, 633, 634, 628

[56] References Cited

U.S. PATENT DOCUMENTS

| | | | |
|---|---|---|---|
| 2,614,858 | 10/1952 | Pierce, Jr. | 280/617 |
| 3,857,186 | 12/1974 | Salomon | 280/616 X |
| 3,987,553 | 10/1976 | Salomon | 280/616 X |
| 4,081,186 | 3/1978 | Beyl | 280/618 |
| 4,135,734 | 1/1979 | Salomon | 280/618 |
| 4,266,806 | 5/1981 | Weigl et al. | 280/633 X |
| 4,358,132 | 11/1982 | Beyl | 280/628 |
| 4,573,701 | 3/1986 | Nowak et al. | 280/618 X |
| 4,616,843 | 10/1986 | Freisinger et al. | 280/618 |

FOREIGN PATENT DOCUMENTS

| | | | |
|---|---|---|---|
| 0371349 | 6/1983 | Austria . | |
| 0376136 | 10/1984 | Austria . | |
| 674574 | 11/1963 | Canada | 280/618 |
| 2902702 | 8/1979 | Fed. Rep. of Germany | 280/617 |
| 3932438 | 4/1990 | Fed. Rep. of Germany | 280/617 |
| 831226 | 5/1938 | France . | |
| 2344305 | 10/1972 | France . | |

*Primary Examiner*—Brian Johnson

*Attorney, Agent, or Firm*—Guido Modiano; Albert Josif

[57] ABSTRACT

A ski boot fastening device includes at least one front and one rear engagement member for a boot which are adapted to be attached to a ski. Independent adjustment members of the two engagement members are provided on at least one of the front and rear engagement members or on the ski. This allows the skier to achieve, by an intervention located in a specific point, an independent adjustment of the two members for the engagement of the boot.

2 Claims, 5 Drawing Sheets

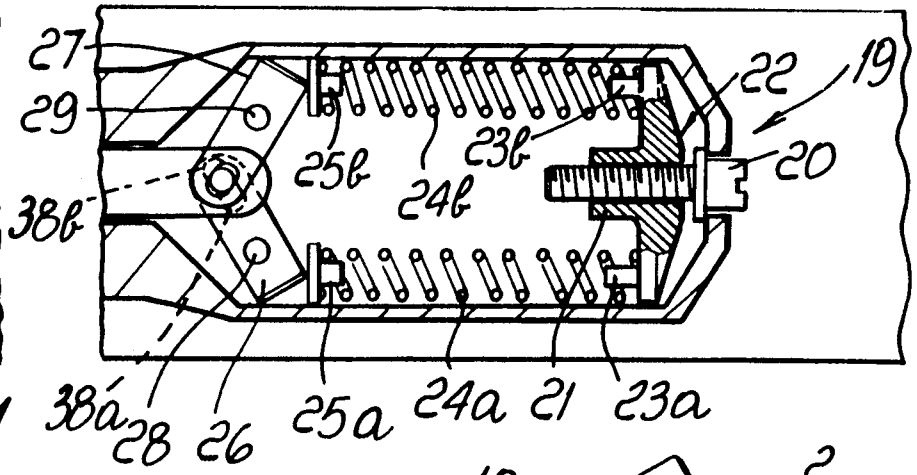
Fig. 1
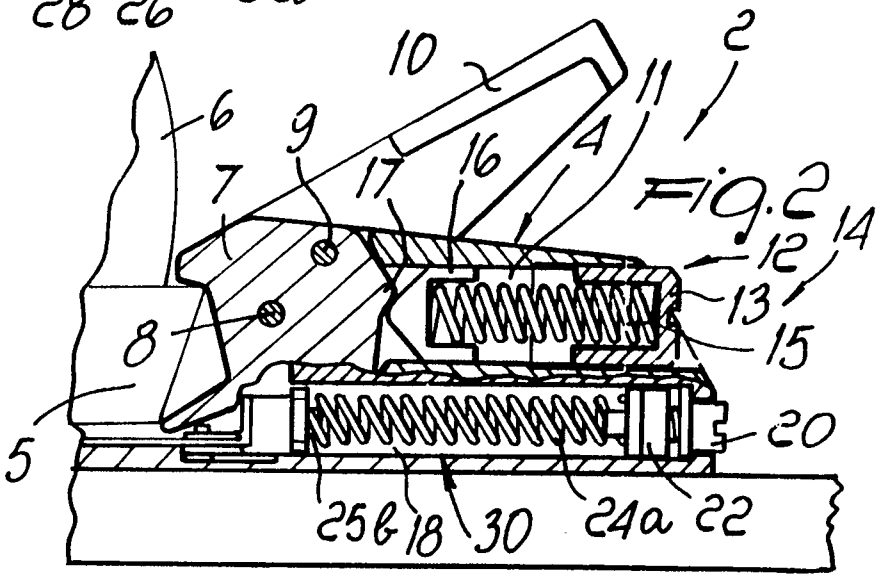
Fig. 2
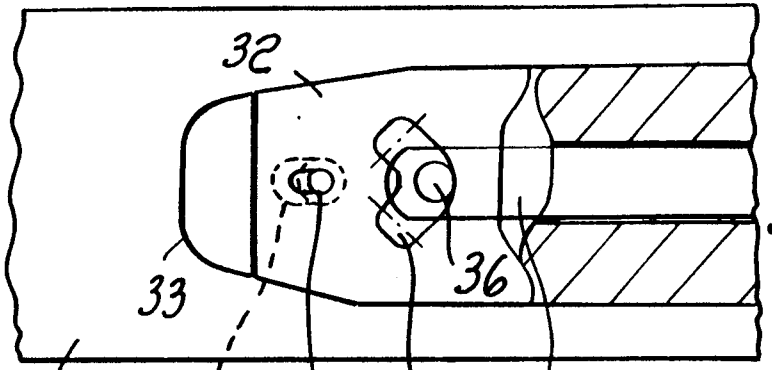
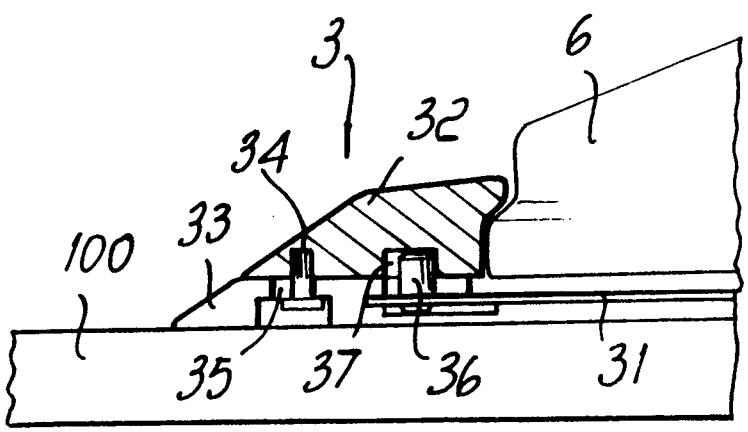

SKI BOOT FASTENING DEVICE

This is a continuation application of application Ser. No. 07/600,885 filed on Oct. 22, 1990. now abandoned.

BACKGROUND OF THE INVENTION

1. Field of the Invention

The present invention relates to a ski boot fastening device.

The known ski boot fastening devices are currently usually composed of a heel element and a tip element which are associated with the ski for the engagement of the ends of a ski boot.

Each of said heel and tip elements therefore has adapted and distinct adjustment means for the correct engagement, release and securing of the boot.

This solution however forces the skier to operate separately on the heel element and on the tip element in order to achieve the optimum adjustments.

2. Description of the Related Art

As a partial solution to this disadvantage, an Austrian Patent No. 376,136 filed on Jan. 21, 1983, discloses a ski boot fastening device comprising lateral and rear engagement elements, adjustment means for both engagement elements being provided on the rear engagement elements.

Said known ski boot fastening device, however, has the disadvantage of providing a common and simultaneous adjustment for the two engagement elements; such an adjustment can only be a compromise due to the different requirements of the lateral and rear elements.

An Austrian Patent No. 371,349 filed on Jun. 12, 1981 is also know to disclose a ski boot fastening device comprising front and rear engagement elements as well as adjustment means interposed therebetween.

Even for this solution, however, there is the disadvantage of having a common and simultaneous adjustment for both of the engagement elements.

It has furthermore been generally observed that possible deflections of the ski during its use are hindered because the heel element and the tip element are not mutually connected.

SUMMARY OF THE INVENTION

The aim of the present invention is therefore to eliminate the disadvantages described above in known types by providing a ski boot fastening device which allows an optimal longitudinal rod 131. It is apparent that when the tip element is forced to rotate, in the direction of arrows 152 or 153 for example, the pin pushes the cam member 136 toward the left (with respect to FIGS. 3 and 6), therefore moving the longitudinal rod 131 also to the left.

Another important object is to provide a ski boot fastening device in which at least one of the engagement means can have small dimensions, be structurally simple and have a simpler design from an aesthetic point of view.

Another important object is to provide a ski boot fastening device which is reliable and safe in use.

This aim, these objects, and other aims and objects of the present invention which will become apparent hereinafter, are achieved by a ski boot fastening device as defined in the appended claims.

BRIEF DESCRIPTION OF THE DRAWINGS

Further characteristics and advantages of the invention will become apparent from the detailed description of a particular embodiment, illustrated by way of non-limitative example in the accompanying drawings, wherein:

FIG. 1 is a partially sectional broken top view of the ski boot fastening device;

FIG. 2 is a side sectional view of the ski boot fastening device taken along a longitudinal median plane of FIG. 1;

DESCRIPTION OF THE PREFERRED EMBODIMENTS

Figure 3:
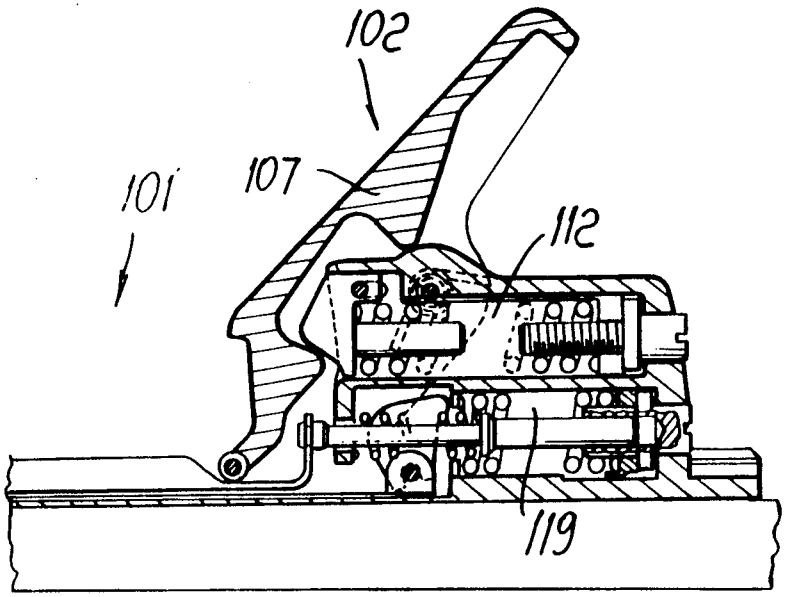
FIG. 3 is a view similar to that of FIG. 2, of a ski boot fastening device according to a second aspect of the invention.

With reference to the above figures, the ski boot fastening device, indicated by the reference numeral 1, is constituted by a rear engagement means 2 and by a front engagement means 3 which are associated with the ski 100.

The rear engagement means 2 comprises a heel element 7 pivoted transversely at one end of a case 4 at a first pin 8 adjacent to the ski 100. The heel element 7 engages the heel 5 of a ski boot 6.

A lever 10 is furthermore associated with the heel element 7 at the first pin 8 and at a second pin 9; by turning down the lever 10, toward the underlying ski, said heel element 7 is rotated, consequently lifting the heel 5 of the boot and therefore opening the fastening.

A first seat 11 for a first adjustment means 12 for the heel element 7 is furthermore defined axially within the case 4; said adjustment means is constituted by a first screw 13 which can be inserted at the rear region 14 of the case 4 and compresses a first spring 15 at a point member 16 which is axially slidable in the first seat 11 and engages an adapted cam 17 provided rearward to said heel element 7.

A second seat 18 for a second means 19 for the adjustment of the front engagement means 3 is defined, below the first seat 11, on the case 4.

Said second seat 18 is also defined axially to the case 4 along an axis which coincides with the longitudinal axis of the ski 100.

The head of a second screw 20 protrudes from the case 4 at said second seat 18 and at the region 14; the stem of said screw is associated with a complementarily threaded seat defined at the stem 21 of a T-shaped lug 22.

A pair of first pins **23*a* and 23*b* protrudes at the wings of said lug toward the front engagement means, and a second pair of springs 24*a* and 24*b*** is arranged coaxially to said pins.

The opposite ends of said pair of springs are arranged coaxially to a pair of second T-shaped pins **25*a* and 25*b*** which abut respectively at a first 26 and second 27 identical levers, each freely pivoted in a median region respectively at a third pin 28 and at a fourth pin 29 which protrude perpendicular from the base 30 of the case 4. Each lever 26,27 is also freely pivoted, at its other end, to a rod 31 at a single pin which is slidable in adapted first slots 38*a* and 38*b* defined at the adjacent ends of the respective first lever 26 and second lever 27.

Said rod 31 is arranged approximately at the median axis of said rear and front engagement means.

Said front engagement means is constituted by a tip element 32 for the engagement of the front end of the ski boot 6 which is slidably associated at a base support 33, which is associated with the ski, by means of an adapted fifth pin 34 rigidly associated with the tip element 32, and is slidable at an adapted second slot 35 defined longitudinally on the base support 33.

Advantageously, said base support and the rod 31 can be extendable or retractable, for example by telescoping, or in any other suitable way, to adjust its length in order to adapt to different boot sizes.

The rod 31 is connected to the tip element 32 by means of a sixth pin 36 which is rigidly associated with the end of said rod 31 and is accommodated at an adapted third seat 37 provided on said tip 32.

Said third seat 37 is V-shaped, with its vertex directed toward the rear engagement means 2.

The use of the ski boot fastening device is therefore as follows: initially, the skier, acting only at the rear engagement means 2, adjusts the degree of securing of the heel element 7 on the heel 5 of the boot 6 by acting at the first screw 13.

The front engagement means 3 is adjusted by acting again at the second screw 20 associated at the rear engagement means 2; a compression of the second pair of springs 24*a* and 24*b* corresponds to a clockwise rotation of said second screw.

A lateral thrust of the boot at the tip element 32 causes the sliding of the sixth pin 36 at the wings of the third seat 37, causing a translatory motion of the rod 31 toward the tip of the ski; said translatory motion leads to a compression of the second pair of springs 24*a* and 24*b* which will oppose the release of the ski boot fastening device up to a preset limit.

It has thus been observed that the invention has achieved the intended aim and objects, a ski boot fastening device having been obtained in which the means for the adjustment of the tip element and of the heel element can be, for example, integrated in the rear engagement means or, as an alternative, in the front engagement means or, again as an alternative, at the ski, keeping the rear and front adjustments independent and distinct.

The adjustment means can in fact also be provided on the ski, and this allows to locate them in a more convenient portion of the ski, where more room is available.

The fact is furthermore stressed that the illustrated ski boot fastening device allows an elastic recovery of the plays due to the deflection of the ski in the region of the ski boot fastening device, since the tip element 32 can slide at the base support 33 due to the presence of the second slot 35.

The ski boot fastening device according to the invention is naturally susceptible to numerous modifications and variations, all of which are within the scope of the same inventive concept.

FIGS. 3–6, for example, show a ski boot fastening device 101, according to a further aspect of the invention, comprising a rear engagement means 102 and a front engagement means 103, associated with a ski 100. The ski boot fastening device 101 is substantially similar to the fastening 1 described above, and the rear engagement means 102 comprises a heel element 107 pivoted at a case 104 and adapted to engage the heel 5 of a ski boot 6. A first adjusting means 112 comprises a first spring 115, adjusted by a first screw 113, and biasing a point member 116 against a heel cam 117 formed on the heel element 107.

A second adjusting means 119 comprises a shaft 121 having a first end 140 connected to a portion 130 of the ski boot fastening device structure, and a second end inserted and abutting in a hole of a second screw 120. The screw 120 has as external threading engaged with a slider 141 in such a way that, by turning the screw 120, the slider 141 slides with respect to the case 104. A second spring 124 is coaxially arranged on the shaft 121, between the slider 141 and a pusher 125 which can freely slide on the shaft 121. The shaft 121 also has a flange 142 and a third spring 129, arranged between the flange 142 and a portion 144 of the case, for biasing the shaft 121 in abutment with the screw 120. A pair of cams 126 is arranged at the pusher 125, each cam 126 being pivoted, by means of a pivot 127, to the case 104. Each cam 126 has an upper section 128 abutting against the pusher 125, and a lower fork section 145 engaging a transverse cam pivot rod 138. The cam pivot rod 138 is associated with a longitudinal rod 131 connected with the front engaging means 103. Turning the adjusting second screw 120, adjusts the biasing force of the second spring 124 against the pusher 125, which contrasts the clockwise rotation (with reference to FIG. 4) of the cam 126 moved by the leftward motion of the rod 131.

It is seen that the leftward (with reference to FIG. 4) motion of the longitudinal rod 131 causes an equivalent leftward motion of the cam pivot rod 138, since the cam pivot rod 138 is directly connected to the longitudinal rod 131. Such leftward motion of the cam pivot rod 138 thereby causes a closkwise (with reference to FIG. 4) rotation of the cam 126, due to the fact that the lower fork section 145 of the cam 126 is pivoted about the cam pivot rod 138. Such rotation of the cam 126 is however contrasted by the pusher 125 which directly engages the upper section 128 of the cam 126. As described above, the contrast force of the pusher 125 against the cam 126 is adjustable by means of a rotation of the second screw 120 which moves the slider 141 to thereby determine the biasing force of the second spring 124 which is arranged between such slider 141 and the pusher 125. Therefore, a rotation of the cam 126 will only occur if the adjustable contrast force of the pusher 125 against such cam 126 is overcome, and accordingly, the force required to move the longitudinal rod 131 leftward (with reference to FIG. 4) can be selected by means of adjusting the second screw 120.

Figure 6:
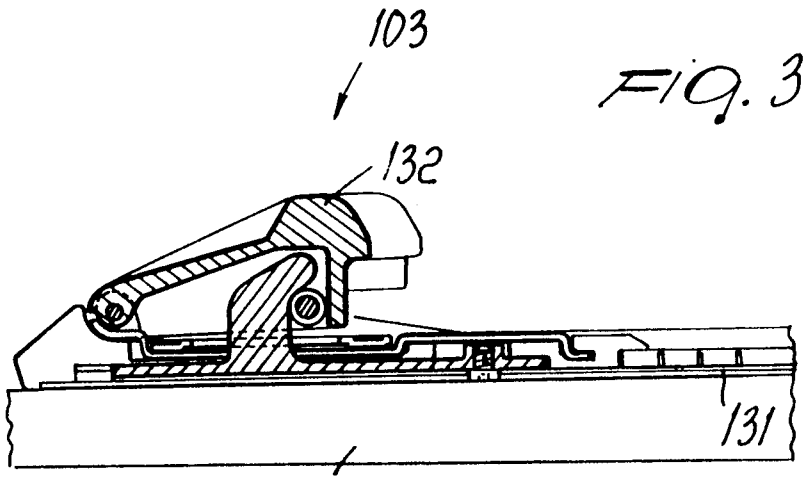
FIG. 6 is a detailed sectional side view of the front engagement means of the ski boot fastening device of FIG. 3.
Figure 6:
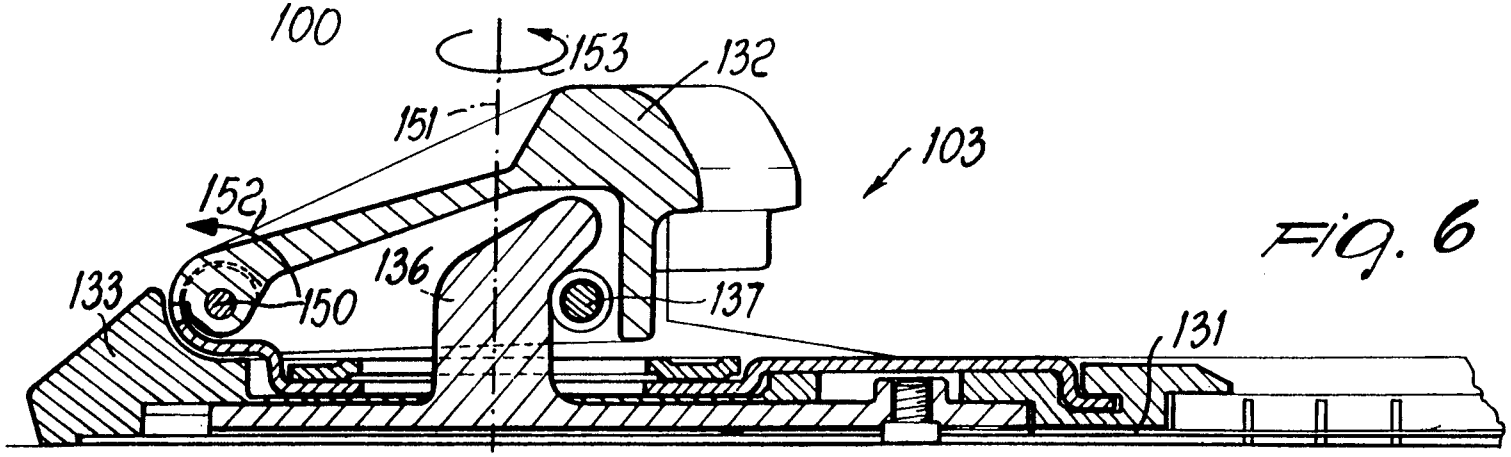
Figure 4:
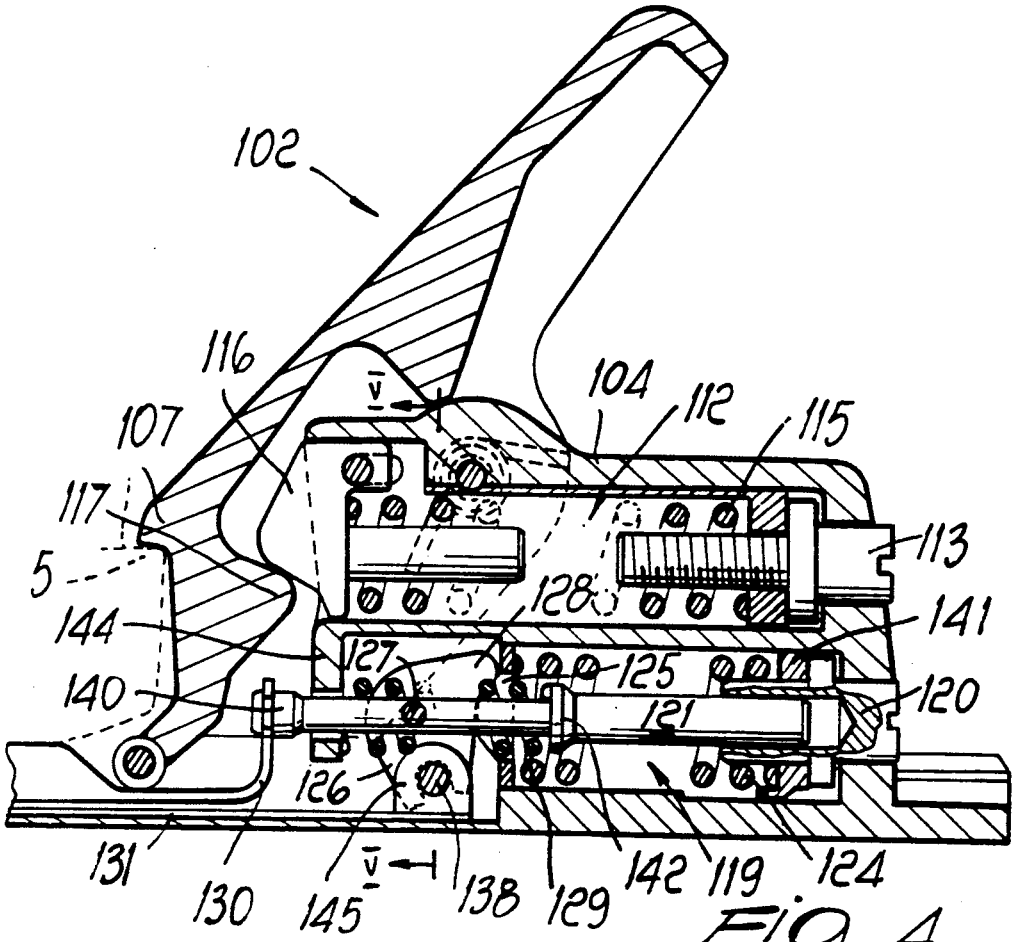
FIG. 4 is a detailed sectional side view of the rear engagement means of the ski boot fastening device of FIG. 3.
Figure 5:
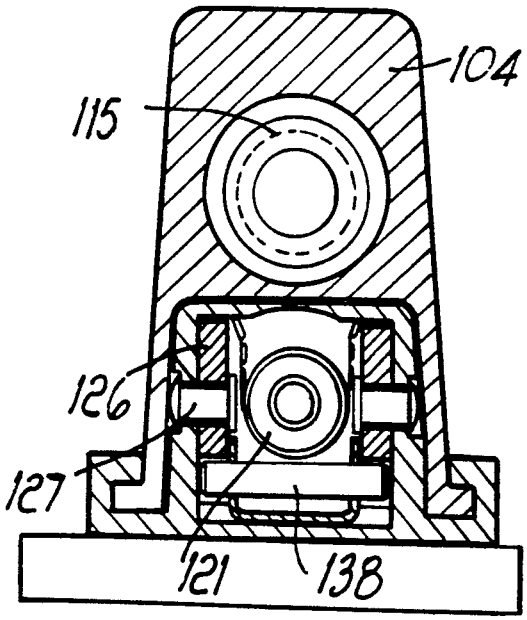
FIG. 5 is a front section partial view of the rear engagement means of FIG. 4.

With particular reference to FIG. 6, the front engagement means 103 comprises a tip element 132 pivoted to a base support 133 and adapted to rotate according to a transverse horizontal axis 150 and according to a vertical axis 151. The tip element comprises a horizontal pin 137 which engages a second cam member 136 connected to the longitudinal rod 131. It is apparent that when the tip element is forced to rotate, in the direction of arrows 152 or 153 for example, the pin pushes the cam member 136 toward the left (with respect to FIGS. 3 and 6), therefore moving the longitudinal rod 131 also to the left.

The operation of the ski boot fastening device 101 is substantially similar to the operation of fastening 1 described above.

Figure 7:
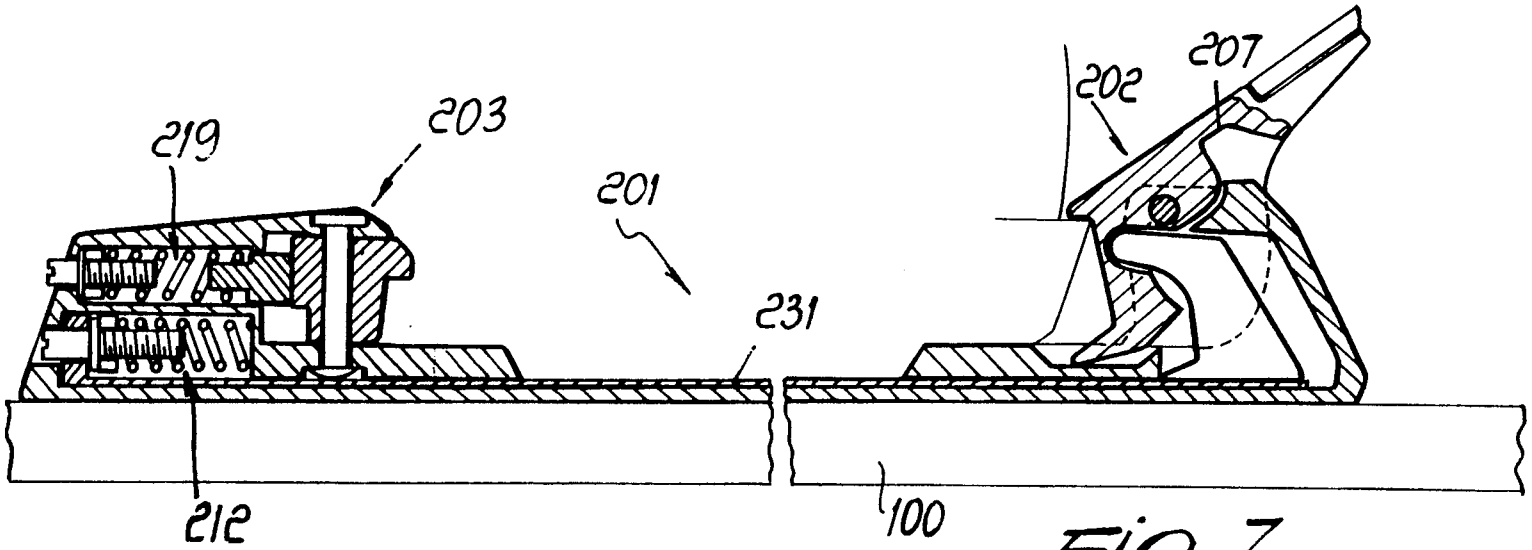
FIGS. 7, 8 and 9 are views, similar to that of FIG. 2, of ski boot fastening devices respectively according to three further aspects of the invention.
Figure 8:
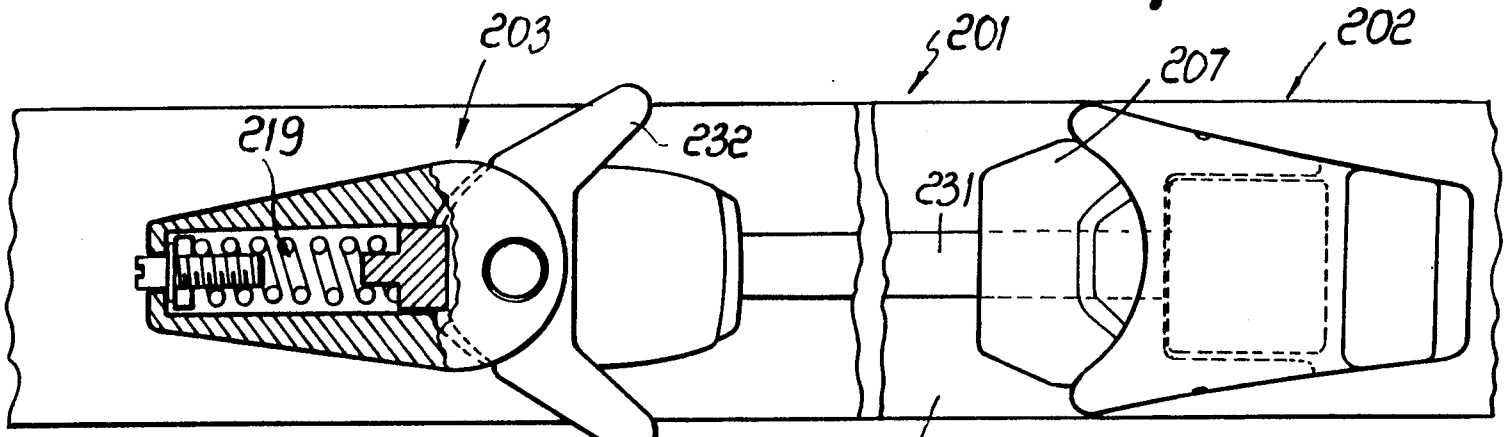

FIGS. 7–8 schematically illustrates a ski boot fastening device 201, according to a further aspect of the invention, comprising a rear engagement element 202 and a front engagement element 203, and wherein the first and second adjusting means, respectively 212 and 219, are associated with the front engagement means 203. The first adjusting means 212 acts on the tip element 232 and the second adjusting element 219 acts on the heel element 207, by means of the longitudinal rod 231, substantially as described above.

Figure 9:
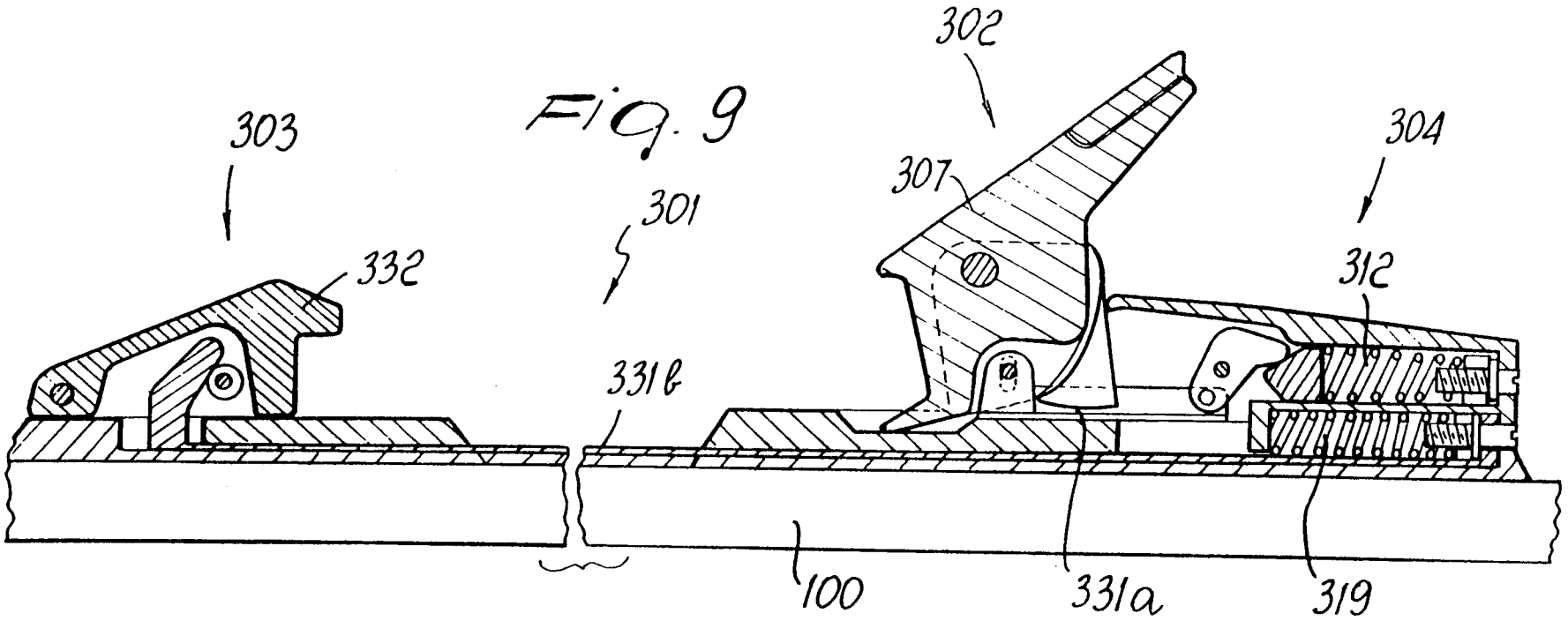

FIG. 9, schematically illustrates a ski boot fastening device 301, according to still a further aspect of the invention, comprising a rear engagement element 302 and a front engagement element 303, and wherein the first and second adjusting means, respectively 312 and 319, are contained in a casing 304 arranged on the ski 100, behind the rear engagement element. The first adjusting means 312 acts on the heel element 307, by means of a first longitudinal rod 331*a*, while the second adjusting means 319, acts on the tip element 332, by means of a second longitudinal rod 331*b*.

The ski boot fastening devices 201 and 301, respectively illustrated in FIGS. 7, 8 and 9, also substantially operate as described above in detail.

The materials, as well as the dimensions, may also be the most appropriate according to the specific requirements.

What is claimed is:

1. A ski boot fastening device connectable to a ski top portion comprising:

a front engagement device which includes a front engagement element for releasably holding down in a locked position thereof a ski boot front portion;

a rear engagement device which includes a rear engagement element for releasably holding down in a locked position thereof a ski boot rear portion;

first means for providing a first adjustable locking force on said front engagement element which must be overcome for release of said front engagement element from said locked position thereof;

second means for providing a second adjustable locking force on said rear engagement element which must be overcome for release of said rear engagement element from said locked position thereof;

first adjustment means for adjusting said first adjustable locking force; and second adjustment means for adjusting said second adjustable locking force;

the ski boot fastening device being connectable to the ski top portion such that said front engagement device and said rear engagement device are mutually spaced apart, said first means providing an independent adjustment of said first adjustable locking force without affecting said second adjustable locking force and said second means providing an independent adjustment of said second adjustable locking force without affecting said first adjustable locking force, said first adjustment means and said second adjustment means being both connected to a first one of said front and rear engagement devices, the ski boot fastening device further comprising:

a slidable longitudinal rod element which is connected at one end thereof to a first one of said first and second means for providing adjustable forces; and a cam member connected to a second end of said slidable longitudinal rod element for engagement with a first one of said engagement elements and for providing a first one of said adjustable locking forces on said first one of said engagement elements.

2. Device according to claim 1, wherein said first one of said front and rear engagement devices is constituted by said rear engagement device, said first one of said first and second means being constituted by said first means, said first one of said engagement elements being constituted by said front engagement element, and said first one of said adjustable locking forces being constituted by said first adjustable locking force.

* * * * *